US006857812B1

(12) United States Patent
Kergen

(10) Patent No.: US 6,857,812 B1
(45) Date of Patent: Feb. 22, 2005

(54) PROCESS FOR ASSEMBLING AT LEAST TWO CONSTITUENT METAL PARTS IN ORDER TO CREATE A STRUCTURE

(75) Inventor: Richard Kergen, Fexhe-Le-Haut-Clocher (BE)

(73) Assignee: Recherche & Developpement du Groupe Cockerill Sambre, Liege (BE)

( * ) Notice: Subject to any disclaimer, the term of this patent is extended or adjusted under 35 U.S.C. 154(b) by 34 days.

(21) Appl. No.: 10/019,289

(22) PCT Filed: Jul. 5, 2000

(86) PCT No.: PCT/BE00/00080

§ 371 (c)(1),
(2), (4) Date: Jan. 4, 2002

(87) PCT Pub. No.: WO01/02110

PCT Pub. Date: Jan. 11, 2001

(30) Foreign Application Priority Data

Jul. 5, 1999 (EP) ..... 99202194

(51) Int. Cl.[7] ..... B23P 17/00

(52) U.S. Cl. ..... 403/274; 403/282; 403/285; 29/521; 29/524; 29/897

(58) Field of Search ..... 403/274, 279, 403/282, 285; 29/521, 524, 897, 897.3, 897.35, 897.33, 897.31, 897.312; 52/731.2, 731.6, 735.1, 309.13; 280/800; 105/416; 222/1, 173, 185.1, 382

(56) References Cited

U.S. PATENT DOCUMENTS 2,054,703 A * 9/1936 Little ..... 405/43
2,125,692 A * 8/1938 Ragsdale ..... 29/897.35
2,129,624 A * 9/1938 Rafter ..... 52/636
2,818,272 A * 12/1957 DeLay ..... 280/638
3,151,767 A * 10/1964 Nakata ..... 220/689
3,716,895 A * 2/1973 Fohr
3,854,185 A 12/1974 Reid
4,055,133 A * 10/1977 Wessely ..... 413/6
4,190,160 A * 2/1980 Andersen et al.
4,193,247 A * 3/1980 Heckelsberg ..... 52/713
4,356,888 A * 11/1982 Steenberg ..... 182/194
4,554,718 A * 11/1985 Ollinger et al. ..... 52/506.07
4,982,487 A * 1/1991 Maruko et al.
5,238,146 A * 8/1993 Thorne, Jr. ..... 222/1
5,327,631 A * 7/1994 Lincavage
5,383,346 A * 1/1995 Laffler et al.
5,603,153 A * 2/1997 Zmyslowski
6,041,564 A * 3/2000 Shirey ..... 52/506.07

FOREIGN PATENT DOCUMENTS

DE 385642 5/1922
FR 2321962 3/1977

* cited by examiner

*Primary Examiner*—Daniel P. Stodola
*Assistant Examiner*—Victor MacArthur
(74) *Attorney, Agent, or Firm*—Jacobson Holman PLLC

(57) ABSTRACT

The invention concerns a method for assembling at least two simple sheet metal elements (1, 2, 3, 11, 12, 21, 21', 22, 22') for producing a structural part with open section, preferably U-shaped, or closed section, at least one of the metal elements having a high or very high yield strength and low deformability. The invention is characterized in that the metal elements are formed by at least a folding process; the metal elements are arranged relative to each other along a junction section; the metal elements are assembled by a crimped lap-joint (4) along the junction section of said elements.

15 Claims, 12 Drawing Sheets

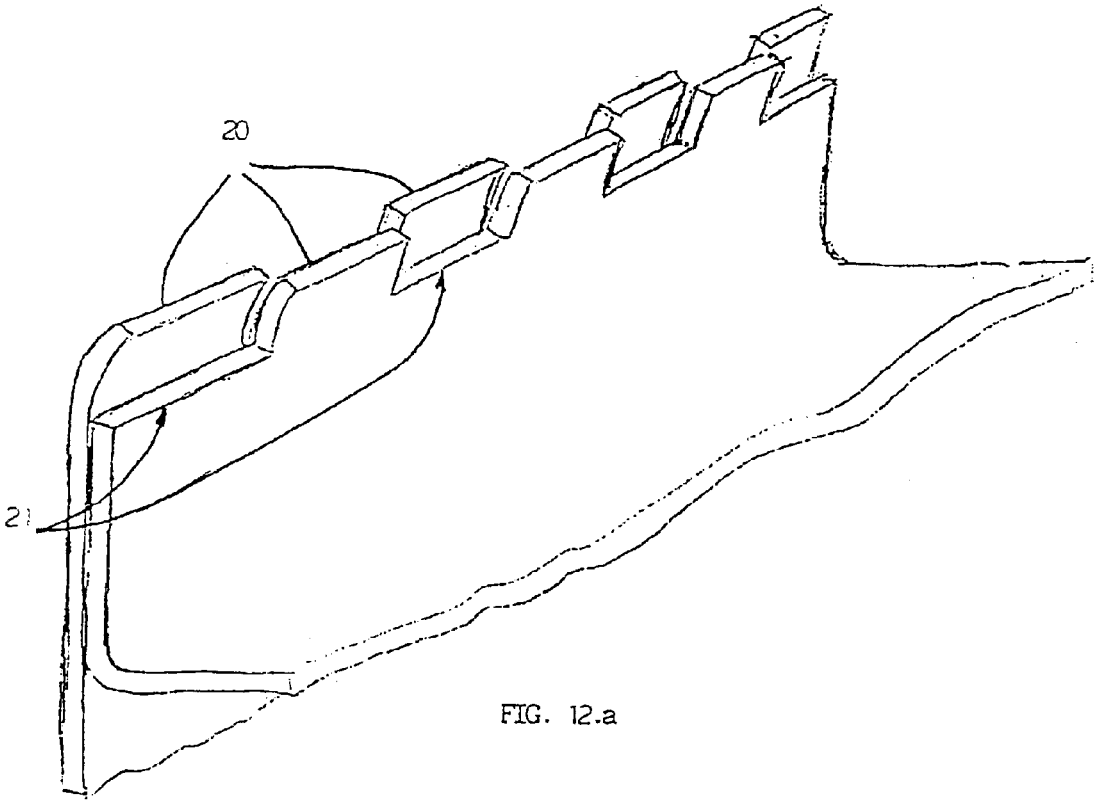
FIG. 12.a
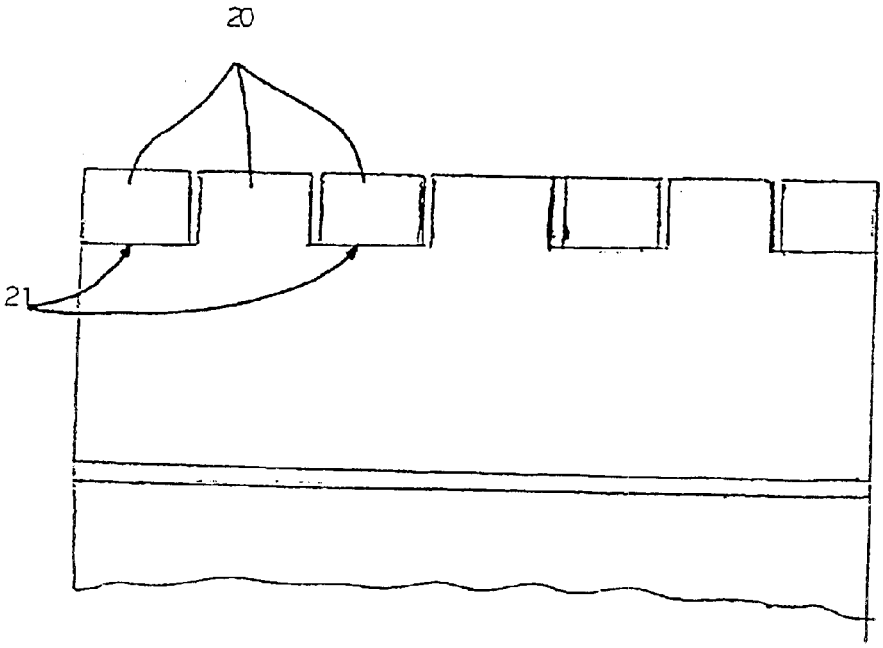
FIG. 12.b

PROCESS FOR ASSEMBLING AT LEAST TWO CONSTITUENT METAL PARTS IN ORDER TO CREATE A STRUCTURE

This is a nationalization of PCT/BE00/00080 filed Jul. 5, 2000 and published in French.

OBJECT OF THE INVENTION

The present invention relates to a process for assembling at least two metal parts in order to create a structure, at least one of the two parts having a very high elastic limit, and to its use for producing (girder) structures of complex form from simple parts, that do not require large deformations.

TECHNICAL BACKGROUND AND PRIOR ART

In the field of mechanical construction and in particular in the automotive field, the objective is to substantially reduce the weight of structures by using the least possible amount of metal. These structures, for example motor vehicle chassis, are obtained by assembling often complex components, performed by drawing.

In order to reduce the thickness of the metal used to produce these structures, while at the same time conserving their mechanical properties, steels with high mechanical characteristics are to be used. Grades of low alloy carbon steels with high mechanical characteristics are nowadays available, but are often associated with a very limited formability by deformation.

To clarify matters, we will differentiate these steels according to their elastic limit (EL) in the remainder of the description:

mild steels: EL<250 MPa;

steels with a high elastic limit (HEL):
250 MPa<EL<600 MPa;

steels with a very high elastic limit (VHEL):
600 MPa<EL<1000 MPa;

steels with an ultra-high elastic limit (UHEL):
1000 MPa<EL<1500 MPa.

Typically, the steels to which this patent application is related have an elastic limit of between 400 and 1500 MPa. These steels are produced by bulk metallurgical processes that are known per se, which allow to offer steels at a cost price close to that of standard carbon steels. The advantage then lies in the fact that an appreciable lightening of the structure can be obtained. However, on account of their low formability and a sometimes poor weldability, these steels pose specific problems in terms of implementation, and in particular of assembly.

More particularly, the constituent parts of a same structure often have complex forms obtained by drawing processes which involve large deformations, and are thus incompatible with the low formability characteristics of these steels.

The process of mechanical hem crimping or the like is well known, for example for assembling parts such as ladders in the field of metal joinery. Thus, document U.S. Pat. No. 4,356,888 describes a structural joint for two parts, preferably made of malleable and deformable metal, such as aluminium. According to one particular embodiment, the first part has an elongated tongue and a short tongue. These two tongues define a cavity capable of receiving the second part at the level of a curved tab on a support such as a wire. When the two parts are pressed together using a suitable tool, the tongues and the tab are deformed and interpenetrate. The elongated tongue forms at least partially a circular loop around the tab, thus making any subsequent stripping impossible.

In the same field of application, document U.S. Pat. No. 3,854,185 proposes a process for forming a structural joint between two rigid parts, one having a flange with a protruding end on one face, and the other having an essentially circular groove. By pressing the two pieces against one another with sufficient force, the flange penetrates into the groove while becoming deformed. More specifically, the assembly is performed by securely LA fastening the flange to the groove, the flange forming a winding in said groove.

Document DE-C-385 642 proposes a machine for crimp assembling two plate metal parts in order to form a hollow body.

Document FR-A-2 321 962 proposes a process for crimp assembling a zinc part and a lead part in order to solve the sealing problems which arise in the field of construction roofing.

AIMS OF THE INVENTION

The present invention aims to propose a process for assembling at least two, constituent metal parts or components, at least one of which is made of a steel with a very high elastic limit associated with low formability, in order to produce structural components of complex form from simpler components which may be produced by means of forming operations essentially of the bending type, which does not involve any large deformations in the plane of the metal plate and is thus compatible with steels having high mechanical characteristics.

Indeed, within a given family of alloys, steels for example, or alternatively aluminium alloys, the higher the elastic limit, the lower the ductility. The level of the elastic limit associated with this low formability depends on the alloy family taken into consideration; thus, this limit may be from 600 to 800 MPa for steels, depending on the grade taken into consideration. Beyond that limit, the steels can only be draw-formed with great difficulty: deformations in the plane of the plate metal by broad tension or expansion will rapidly lead to its breaking. The resilience also makes it very difficult to comply with the geometry of the component. On the other hand, these steels retain deformability by bending. However, since the limiting bend radius is several times the thickness, assembly by crimping is virtually impossible.

However, these steels are of potential value for improving metal structures and in particular motor vehicle structures. They allow to reduce the weight for equivalent performance or even to improve the performance for equivalent weight.

It is therefore important to be able to produce components in complex forms from these metals with high mechanical characteristics, which is the object of the present invention.

MAIN CHARACTERISTIC ELEMENTS OF THE INVENTION

The present invention relates to a process for assembling at least two simple sheet metal parts, in order to create a structural component of open cross section, preferably U-shaped, or of closed cross section, at least one of said metal parts having a high or very high elastic limit and low formability, characterized in that:

the metal parts are formed by at least one bending process;

the metal parts are arranged relative to each other in a junction section;

the metal parts are assembled by crimping at the hem (4) along the junction section of said parts.

At least one of the parts is preferably made of a steel with an elastic limit of more than 400 MPa or of an aluminium alloy with an elastic limit of more than 200 MPa.

Advantageously, the ratio of the hem radius to the sum of the thicknesses of the various parts one wishes to assemble along the junction section is between 2 and 10.

Furthermore, the ratio of the difference between the radius of the hem and the thickness of the outermost metal with the thickness of the innermost metal is advantageously greater than 2.

The nature or thickness of the various parts may not be identical for all the parts.

The process is also characterized in that the junction is not necessarily rectilinear but may have a local curvature, the radius of curvature preferably being greater than five external hem radii.

The assembly process according to the invention is also characterized in that, after the hem crimping operation, blocking of said hem with respect to the sliding of its parts along the junction section is achieved by bonding, indentation or imbrication.

The present invention also relates to the product obtained by the assembly process described above, characterized in that it is in the form of at least two metal parts having a hem along a junction section.

In a first preferred embodiment of the invention, the product is in the form of a two-web I-shaped girder, obtained by assembling four constituent parts connected by four hems along the junction section of the four parts taken in pairs.

In a second preferred embodiment of the invention, the product results from the assembly of two parts by two hems so as to form a closed cross section, at least one of the two parts having a U-shaped cross section.

The process of the invention thus allows to obtain structural components of complex form from sheet metal materials having, on the one hand, a high to very high elastic limit, and, on the other hand, limited formability. The latter is not a constraint as regards preparatory operations for the assembly process, such as bending, involving little deformation in the plane of the metal plate. This process thus allows to obtain components with a geometry which is equivalent to that obtained by drawing. Furthermore, hem assembling is compatible with the low formability of these steels, the working radius being several times the thickness, which is not the case for simple crimping, for example.

Another advantage of the invention is that the process of hem assembling or hem crimping, which is purely mechanical, allows to set aside the possible problems of weldability of steels with high mechanical characteristics.

An additional advantage of the invention is that it proposes a process for producing reinforced structural components, in particular in the motor vehicle industry.

Finally, the process of the invention, which uses a simple press for the assembly, is a cost-efficient process.

BRIEF DESCRIPTION OF THE DRAWINGS

FIG. 12 illustrate the blocking principle of the relative sliding of the web with respect to the flange in the hem assembly process, by imbrication with alternate cut-out spaces. FIGS. 12*a* and 12*b* show the two metal plates just before the production of the hem.

DETAILED DESCRIPTION OF SEVERAL EMBODIMENTS OF THE INVENTION

The basic idea of the invention is to break down a structural component of complex form, usually made by draw-forming operations that are relatively incompatible with steels having high mechanical characteristics, into simple sub-components, made by forming operations such as bending, and hem-assembled.

The present invention will be described in greater detail by means of the enclosed figures.

Figure 1:
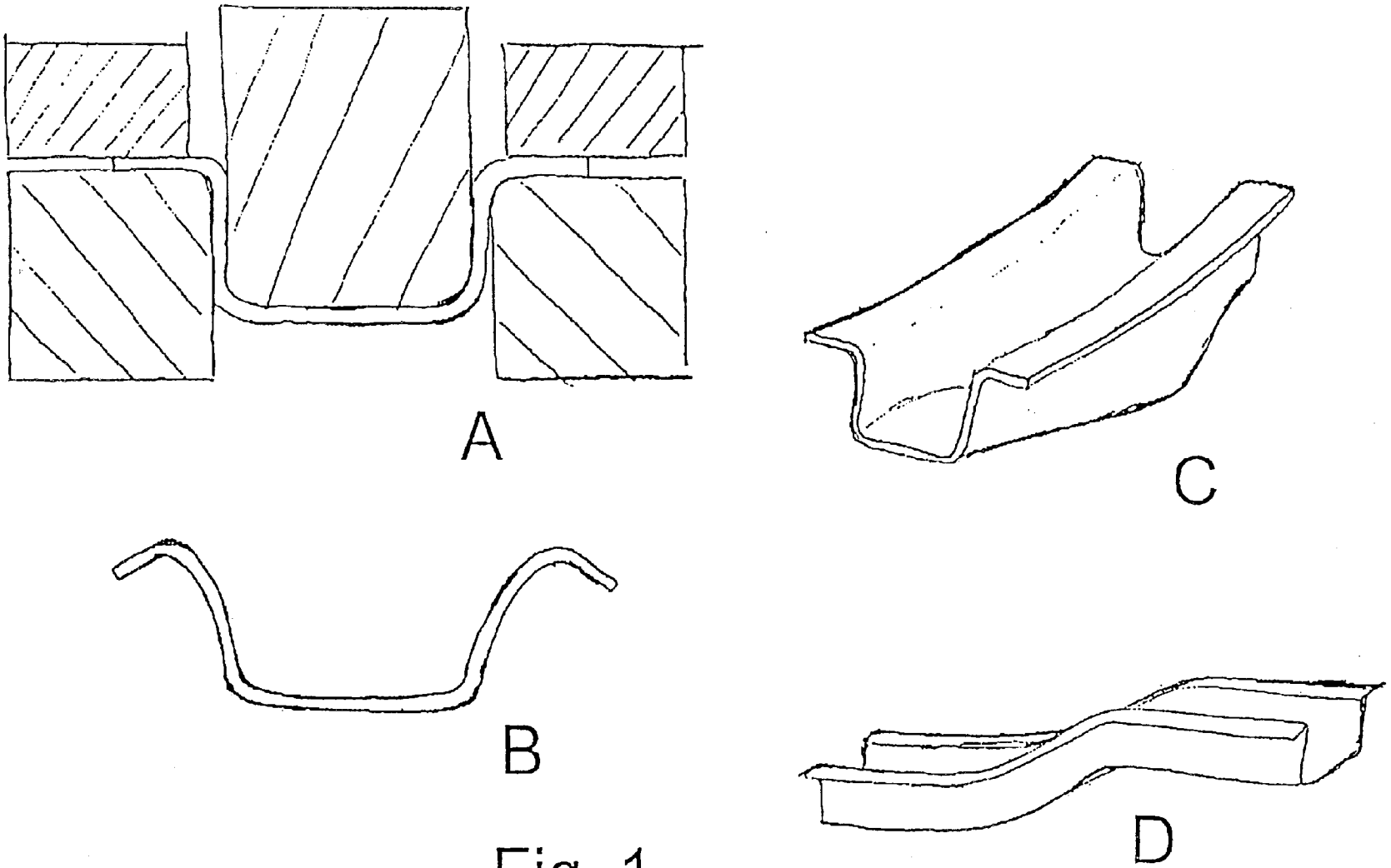
FIG. 1 describe a conventionally produced structure of U-shaped geometry.

FIG. 1 shows the usual method for producing a component of U-shaped geometry. Conventionally, this type of component is obtained by drawing using a flat metal plate, as diagrammatically represented in FIG. 1*a*. In the context of steels with a very high elastic limit, the drawing of such a component poses severe problems in terms of controlling the resilience: the form obtained substantially differs from the ideal form as shown in FIG. 1*b*. Critical problems due to the low formability of this type of steel arise for example when the height of the U-shaped section substantially varies as indicated in FIG. 1*c* or when, with the height of the section remaining constant, the curvature of the U-shaped girder shows substantial local variation (FIG. 1*d*).

Figure 2:
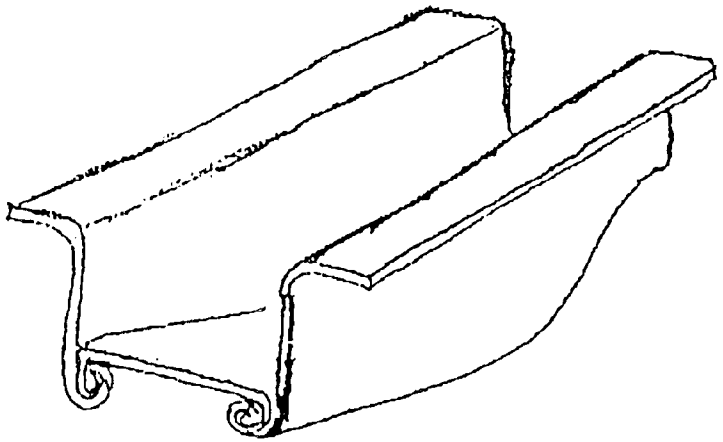
FIG. 2 show the simple constituent parts for creating the same type of structure as that shown in FIG. 1 according to the assembly process of the present invention.
Figure 2:
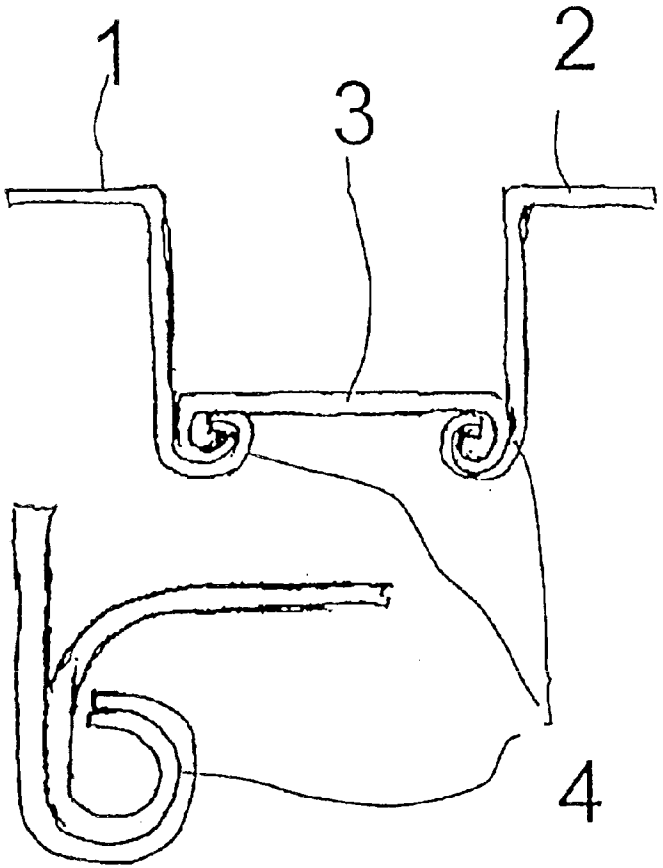

The principle according to the present invention proposed for producing this type of component is illustrated in FIG. 2. The component is broken down into simple components, the sides 1 and 2 and the bottom 3 which are assembled by means of a hem 4.

The components 1, 2 and 3 may be obtained by folding or by bending the edge. These forming techniques only involve small deformations in the plane of the metal plate and are compatible with steels with a very high elastic limit and low formability.

Figure 3:
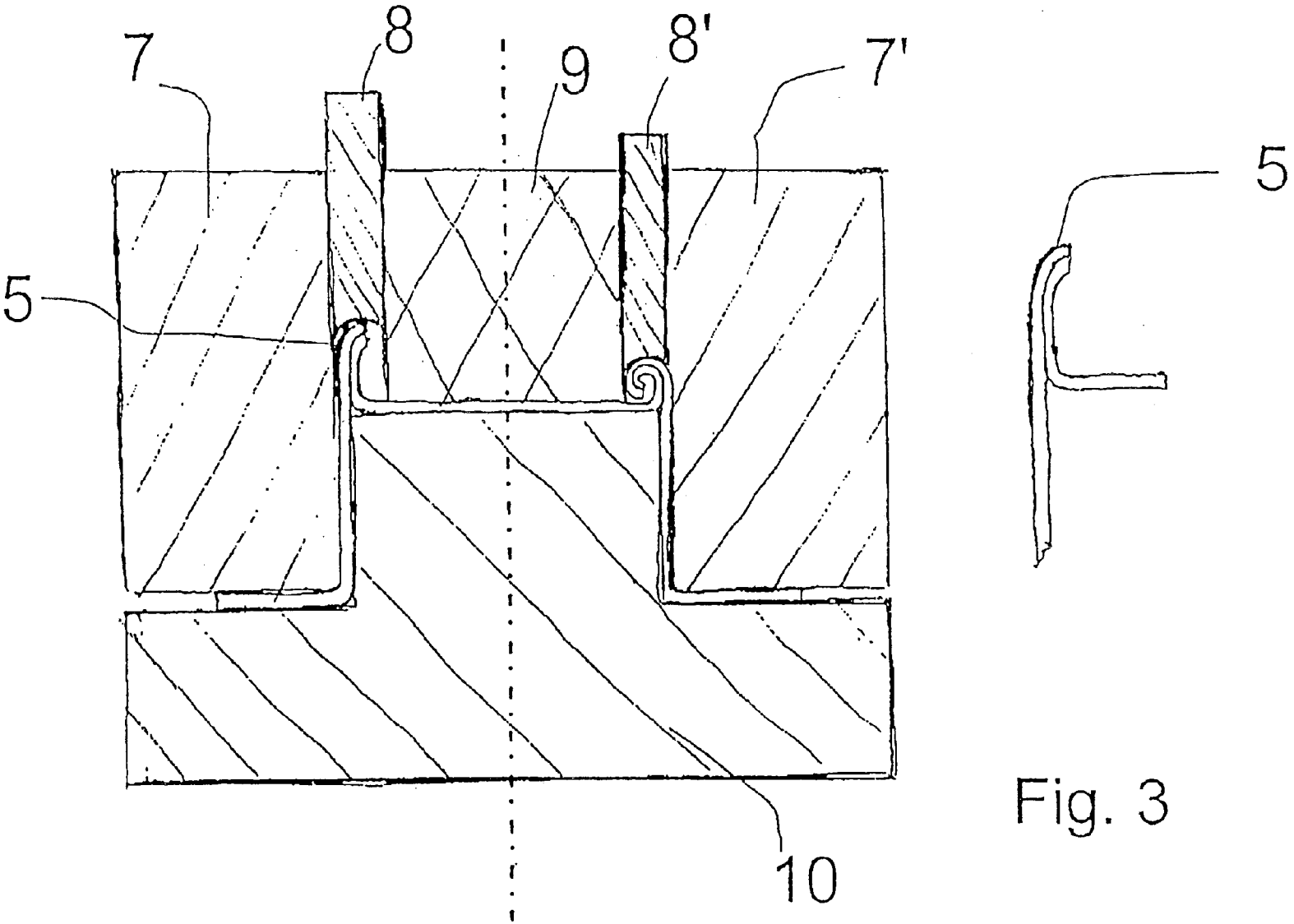
FIG. 3 show a tool for producing a structure as described in FIG. 2.

FIG. 3 shows a typical tool for producing this type of component by means of a press. The side parts 1 or 2 and the bottom 3 are prepared for the formation of the hem as indicated at 5. These components made by means of simple press operations are shown in the tool described in FIG. 3.

The left half-view shows the closed tool, before producing the hem, and the right half-view shows the tool once the hem has been completed. The parts 7, 7' and 9 come to bear on the top slide of the press by means of springs, which are not shown, and whose compression travel is greater than the travel of the tools 8, 8' forming the hem. In the situation shown in FIG. 3, the springs are compressed and press, by means of the parts 7 and 9, the components 1, 2 and 3 against the component 10 which matches their form and rests on the press table. When the press slide comes to the end of its travel, the part 8', which is directly connected to it, forms the hem as indicated in the right-hand side of FIG. 3.

All components 1, 2 and 3 are not necessarily made of steel with a high elastic limit: for example, depending on the function of the component, it is possible for only the component 3 to be made of steel with a very high elastic limit, the steel components 1 and 2 having better formability and better weldability, thus allowing the component to be readily assembled onto the rest of the structure by means of assembly processes such as spot welding. The process also allows to adapt the thicknesses to the structural requirements of the component: the three components 1, 2 and 3 may have different thicknesses, the hem assembly process accepting substantially different thicknesses, the ratio of which is greater than two.

Figure 4:
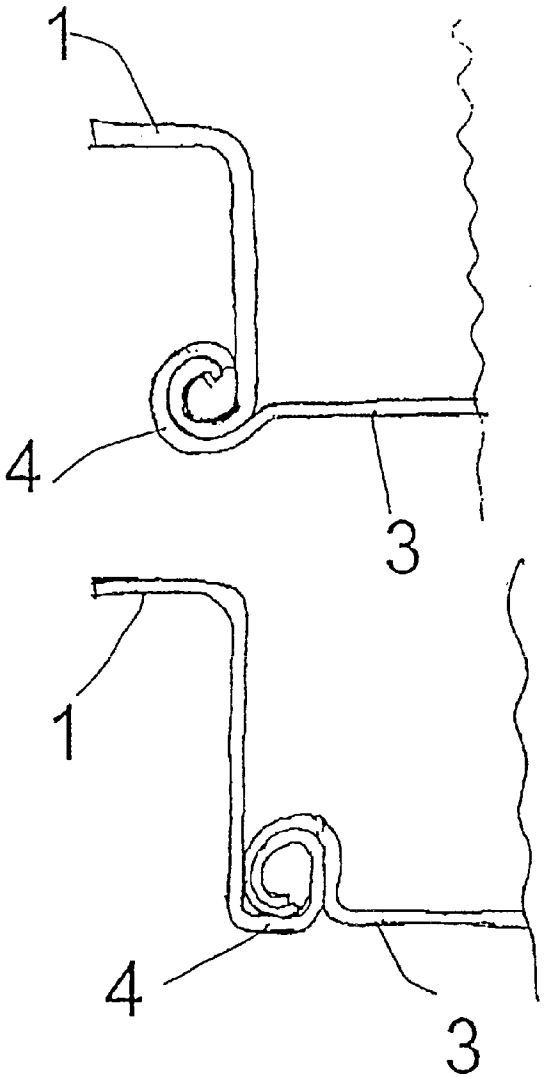
FIG. 4 shows assembly orientation variants for a U-shaped structure.

Orientation variants of the hemming are shown in FIG. 4.

Figure 5:
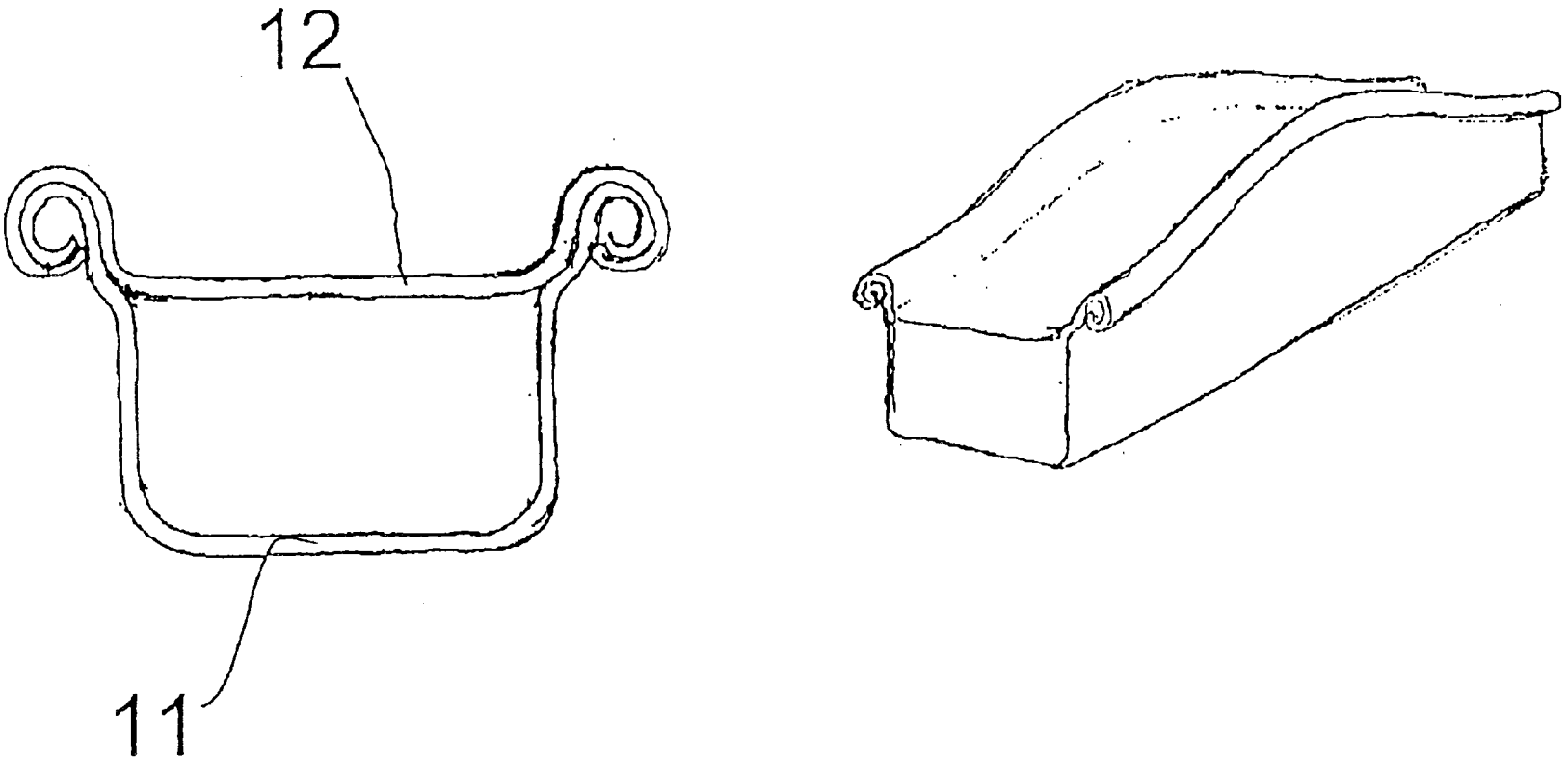
FIG. 5 show a more complex embodiment of a structure of closed cross section obtained according to the assembly process of the present invention.

The process also allows to produce closed cross sections as indicated in FIG. 5. According to FIG. 5, the component 11 may be obtained by simple bending, a variation of the closed cross section being obtained by varying the height of the bent edges. The component 12, which closes the cross section, is of even simpler form. As a variant of this case, the component 11 may also be made by drawing a steel with a lower elastic limit, for example of less than 400 MPa, the component 12 being made of steel with a very high elastic limit and acting as reinforcement.

Figure 6:
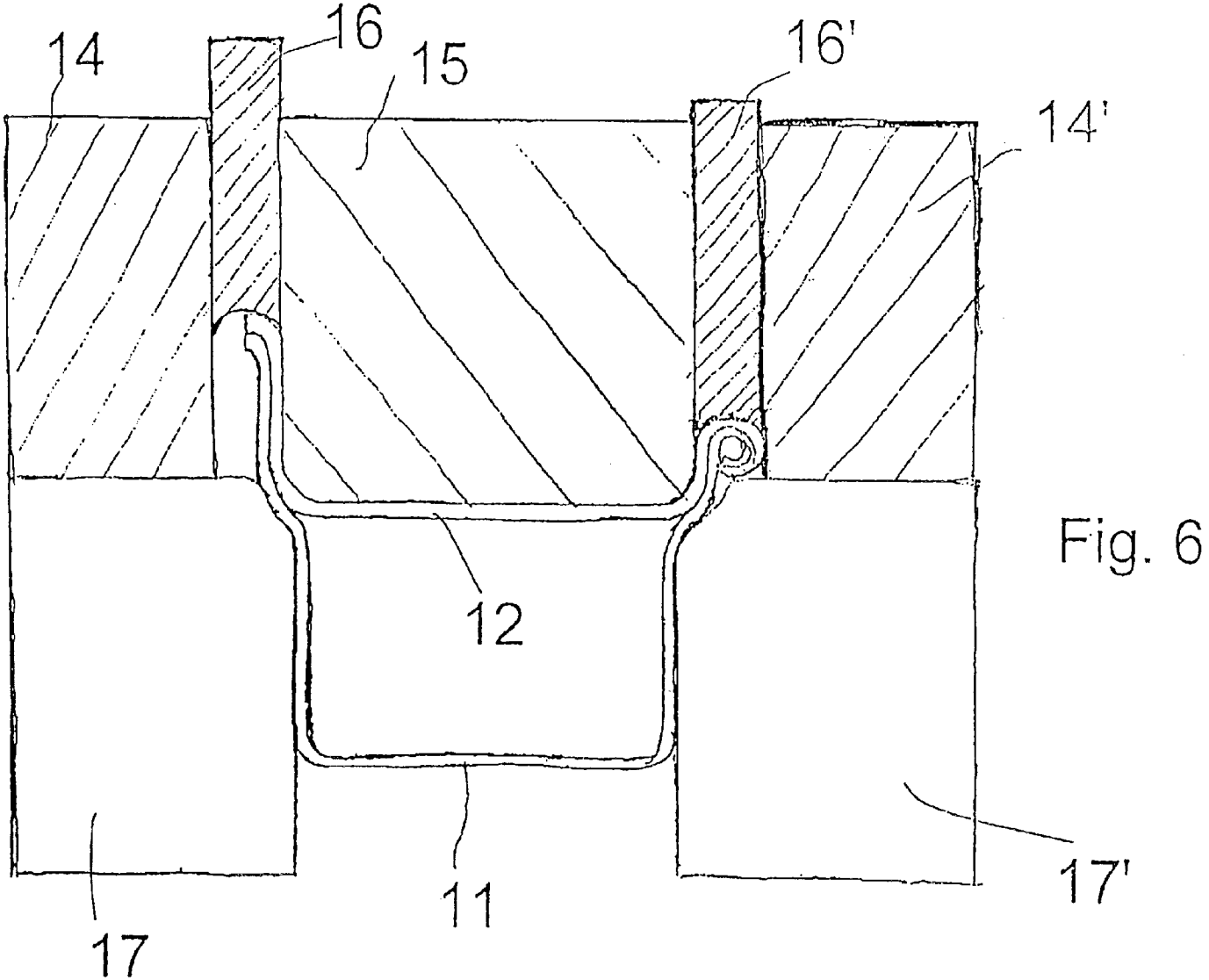
FIG. 6 shows the tool used to produce a closed structure as shown in FIG. 5.

A typical set of tools for producing this type of component is shown in FIG. 6. The principle is similar to that described in FIG. 3. The parts 14, 14' and 15 come to bear on the top slide of the press by means of springs, that are not shown.

The part 15 holds the components 10 and 11 against the part 17-17' which rests on the lower table of the press.

In the left-hand side of the figure, the situation before the formation of the hem is shown: the press slide has brought the parts 14 and 15 into contact, the springs being slightly compressed. The right-hand view shows the situation after forming the hem: the press slide has continued its travel and the part 16', which is directly connected thereto, has formed the hem.

Figure 7:
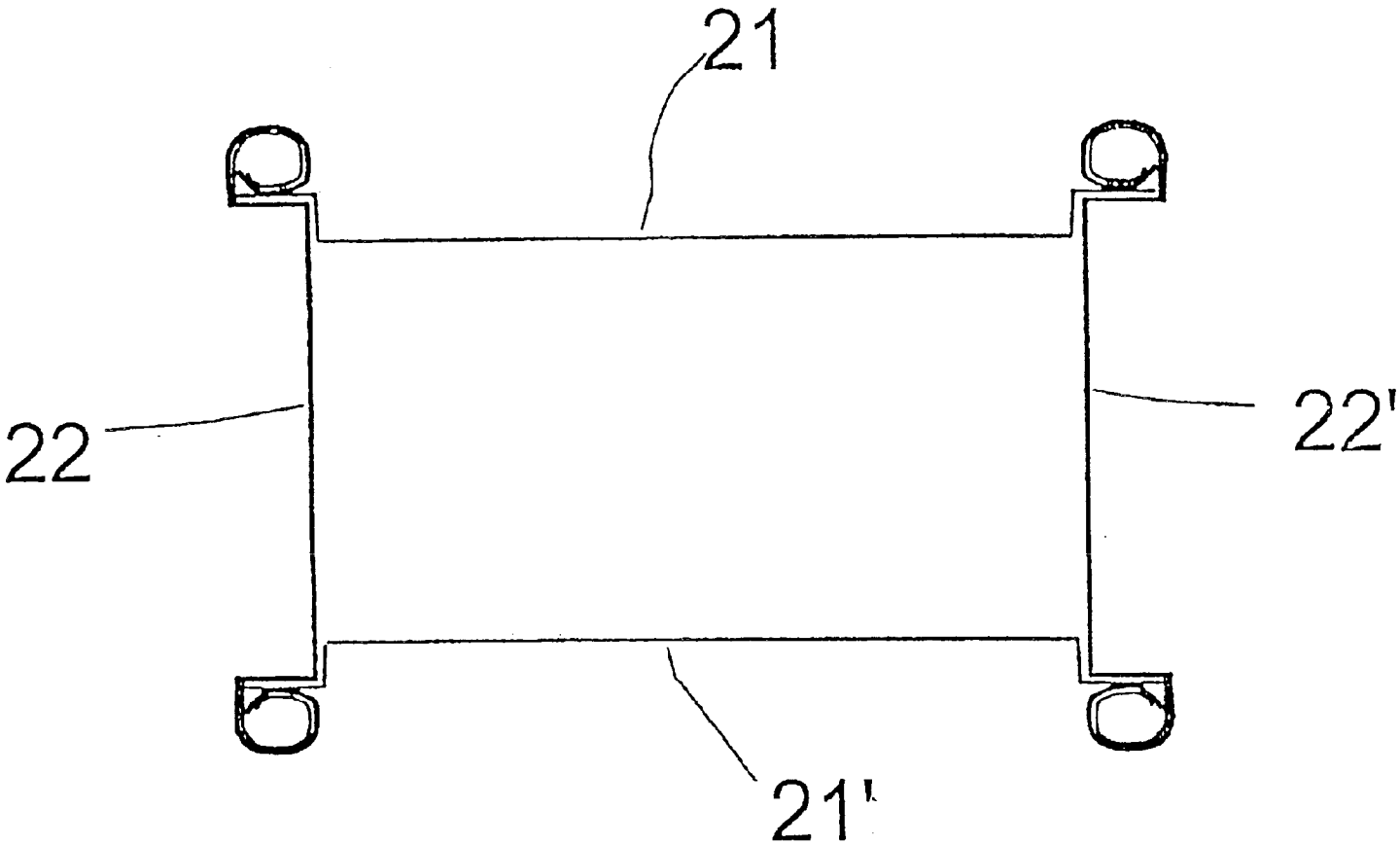
FIG. 7 shows another embodiment of a structure in the form of a two-web I-beam girder.

Another possible embodiment of a closed structure is based on assembling the components by means of four hems. A typical cross section corresponding to this application is shown in FIG. 7. The components 22 and 22' are hem-assembled with the components 21 and 21'.

Figure 8:
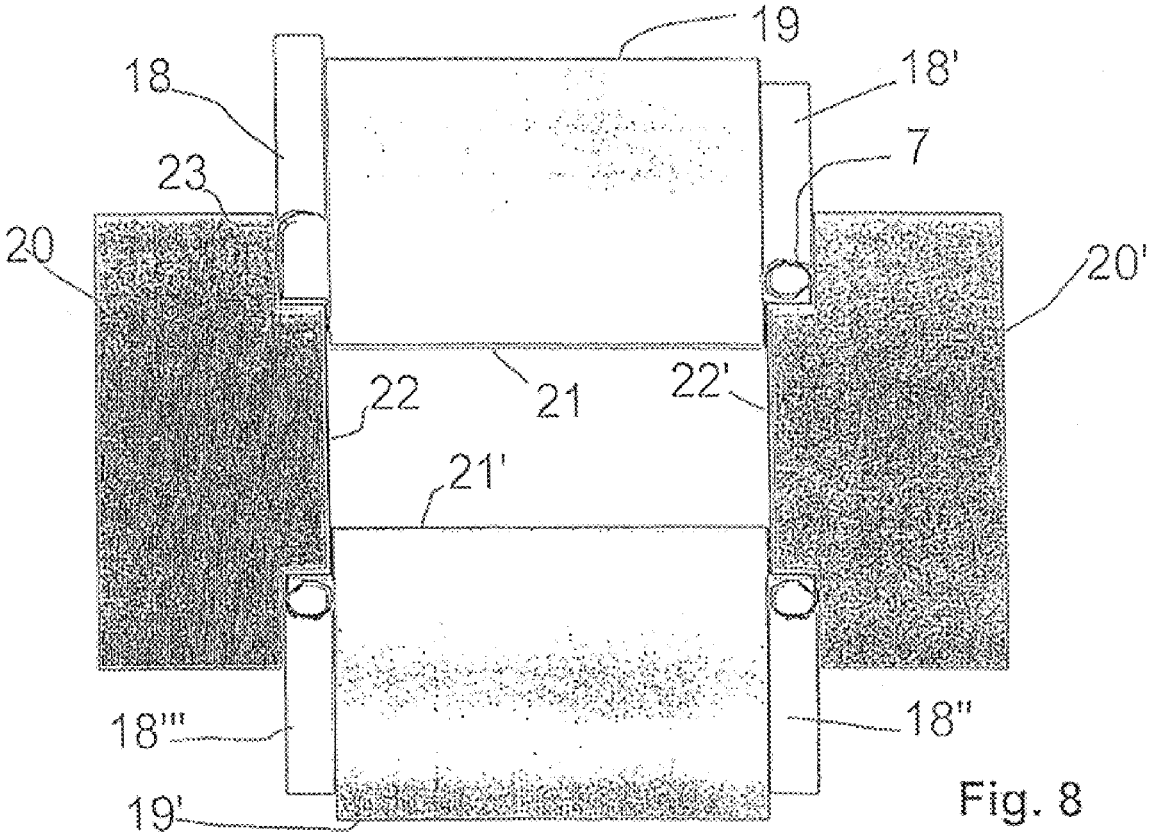
FIG. 8 shows the tool for producing and assembling a two-web I-shaped girder.

FIG. 8 shows a set of tools for hem-assembling his cross section by means of a press. The components 21 and 22 are prepared so as to form the hem as indicated at 23: they have received a preform which initiates the hem. The components are then placed in the set of tools which is composed of moving parts 20 and 20', 19 and 19'. These parts are first separated, horizontally for 20 and 20', and vertically for 19 and 19'. The components 21 and 21' are respectively placed on 19 and 19' and held by means that are not shown, for example a magnetic system. Similarly, the components 22 and 22' are placed on the parts 20 and 20' and held in the same way. All the tools of type 18 (18', 18", 18'") are then in the position indicated for the tool 18. The tools 18 are then successively or simultaneously moved to form the hem and arrive in the position indicated by 18', 18", 18'". This type of tooling can be mounted on a press, the parts 19, 18 and 18' being implemented by means of the top slide of the press; 19 is spring-mounted and its travel is limited by a stop, that is not shown. The part 19' rests on the press table and is thus fixed, the tools 18" and 18'" being set in motion by means of the bottom slide of the press. This type of assembly by means of a press tool allows to produce forms with non-permanent cross section: the distance between the components 21 and 21' and also the distance between the components 22 and 22' can vary.

Figure 9:
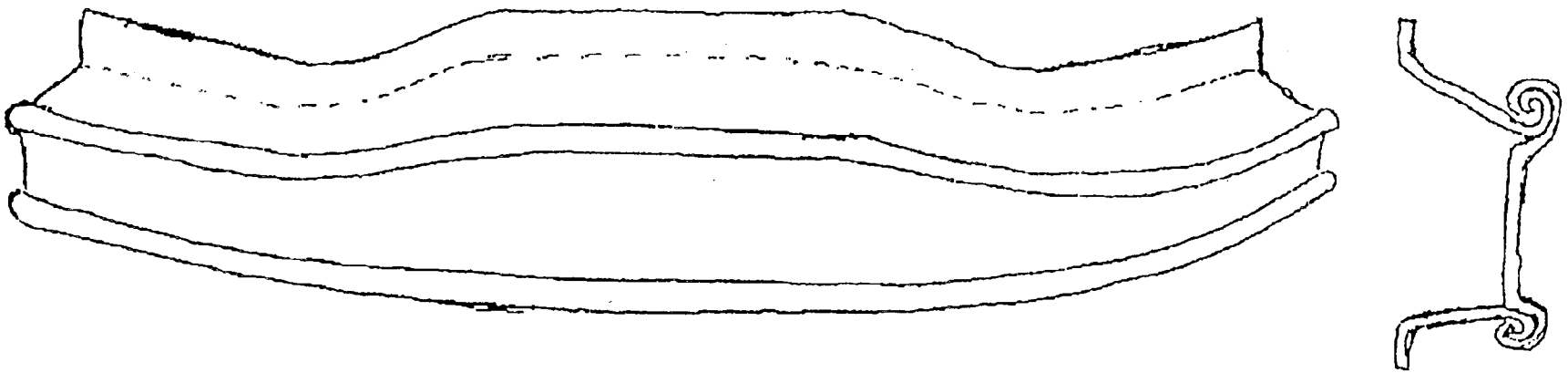
FIG. 9 shows a component of shield crossbeam type.
Figure 10:
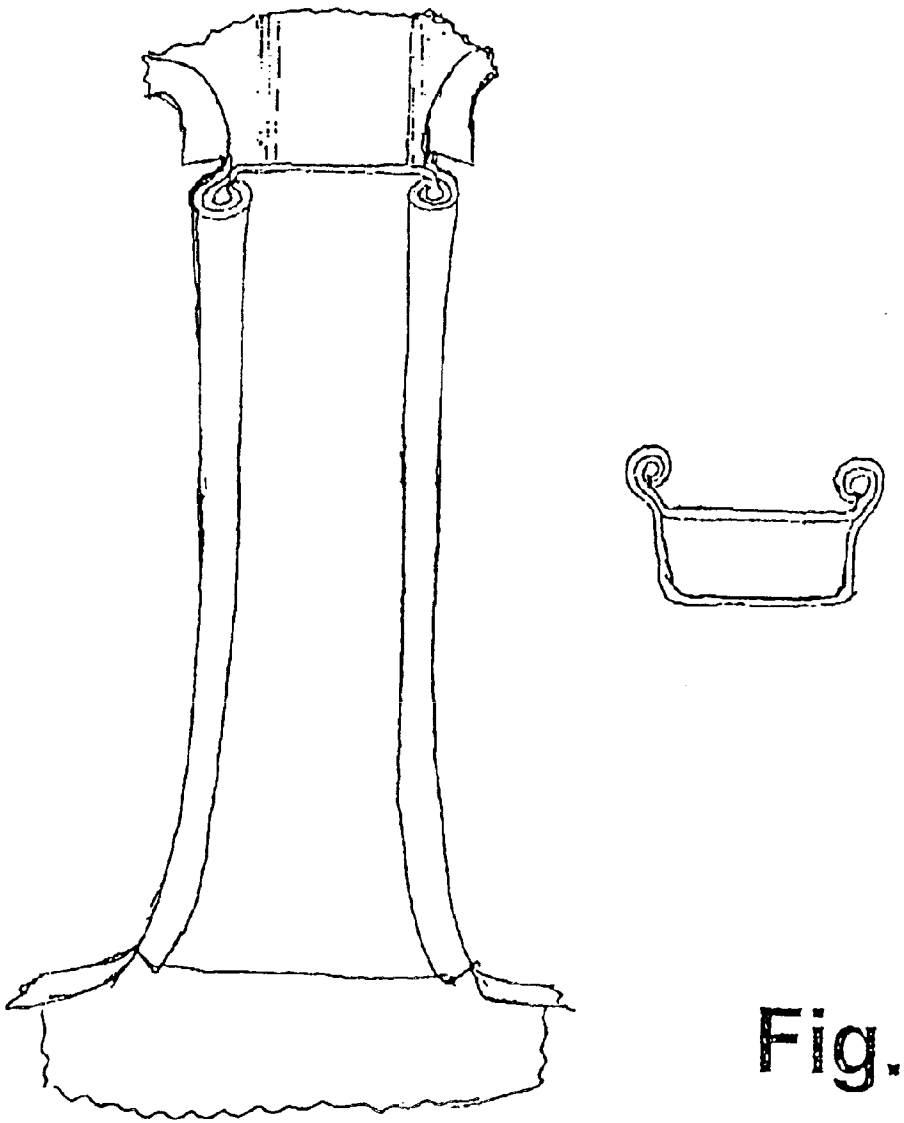
FIG. 10 shows a component of b-pillar type.

The potential applications relate to different types of motor vehicle structural components, for instance body reinforcing components (shield crossbeam), b-pillars, side rail components or engine mounts. Some of these applications are illustrated in FIGS. 8 to 10.

Figure 11:
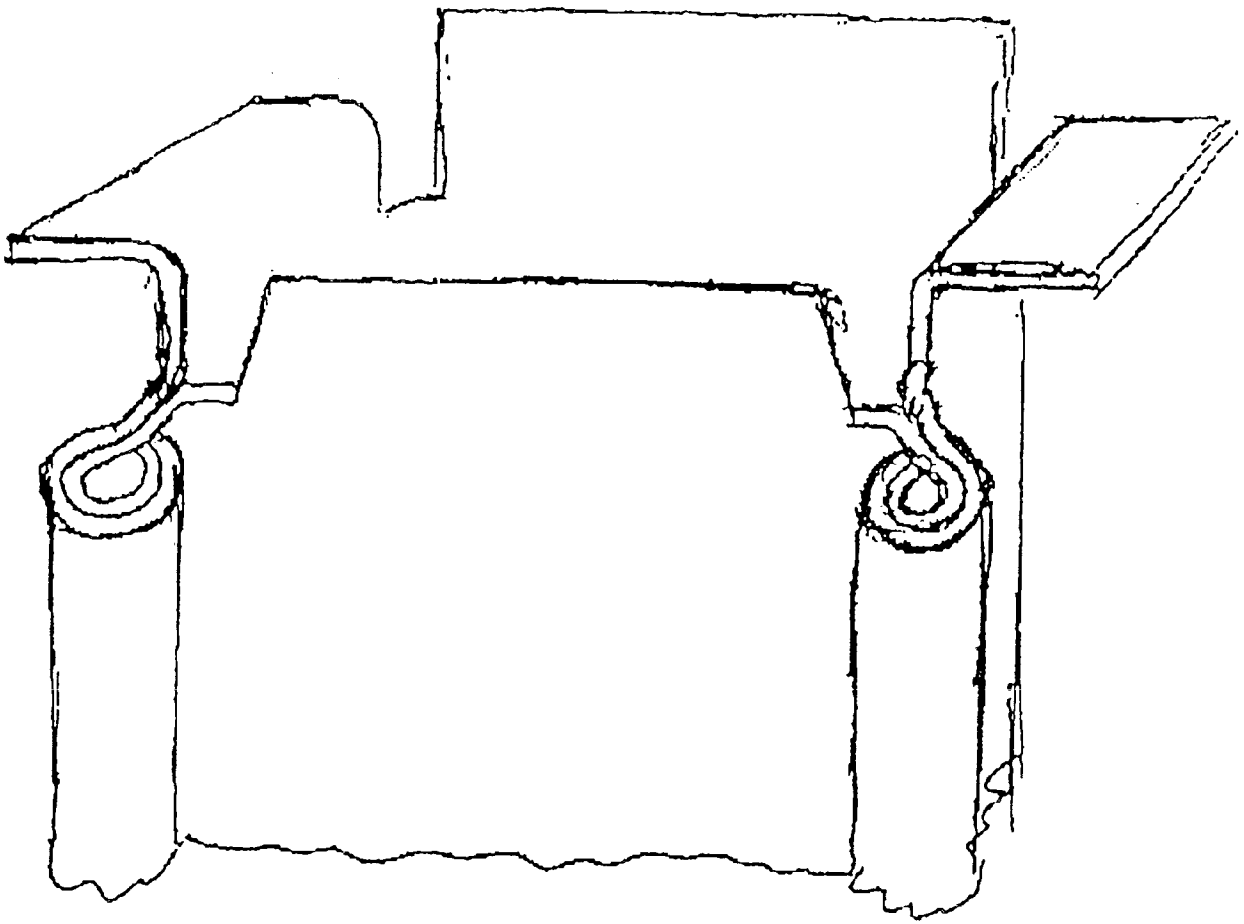
FIG. 11 shows a component with tongues at the ends to facilitate assembly.

The technique allows to produce structures of complex form with steels of very low ductility by taking advantage of the production efficiency of the hem assembly process and of the reinforcement it provides to the structure. It also allows to form metal tongues at the ends of the parts, enabling these components to be readily assembled onto the rest of the motor vehicle structure (FIG. 11).

The hem assembly ensures very good maintenance of metals in the plane perpendicular to the axis of the hem. However, there is an appreciable risk that the assembled parts may slide in the axis of the hem or at least in the longitudinal direction, if the hem is not rectilinear. This drawback may be readily solved, for example by placing an adhesive between the two sheets of metal at the hem, by producing welds by local fusion or, preferably, by locally crushing the hem with a press tool comprising, for example, a V-shaped punch with a rounded end and a flat anvil. This operation may be performed in a highly efficient manner with a press: a set of tools may be designed to simultaneously perform the indentations, the indentation pitch being of the order of 5 to 10 times the outside diameter of the hem.

Alternate serrated cut-outs may also be made in the two metal sheets in the region to be hem-assembled so as to ensure longitudinal blocking (FIG. 12). These cut-outs are made during the steps of manufacturing these components by press. The teeth 20 have a height that is less than the circumference of the hem, for example one-third of this circumference. The width of the teeth 20 is slightly less than that of the gaps 21 between the teeth. During the hem-assembling of the two metal sheets, the teeth of the plate closest to the axis of the hem are imbricated in the space between the teeth of the outer metal sheet, thus producing blocking in the axis of the hem.

What is claimed is:

1. A method for manufacturing a complex shape structural component with an open cross section, preferably U-shaped, or with a closed cross section by assembling at least two simple sheets of metal parts, at least one of said metal parts having an elastic limit of more than 400 MPa, said method comprising the steps of:

bending one or more metal parts to form one or more flanges by at least one bending process;

arranging the flange or flanges so that the metal parts being relative to each other in a junction section;

crimping the flange or flanges along the junction section of the metal parts to form one or more curved hems in order to assemble said parts; and after said hem forming, blocking said hem to prevent the assembled parts from sliding along the junction by imbricating alternate serrated cut-outs made in the two simple sheets of metal parts in a region to be hem-assembled to cooperate for ensuring said blocking along the junction section, said cut-outs being made with a press during manufacturing.

2. The manufacturing method according to claim 1, wherein at least one of the metal parts is made of steel and has an elastic limit of more than 1000 MPa.

3. The manufacturing method according to claim 1, wherein a ratio of a radius of the hem to a sum of thicknesses of the various parts one wishes to assemble along the junction section is between 2 and 10.

4. The manufacturing method according to claim 1, wherein a ratio of difference between a radius of the hem and a thickness of an outermost metal with the thickness of an innermost metal is more than 2.

5. The manufacturing method according to claim 1, wherein the nature or thickness of the various parts is not identical.

6. The manufacturing method according to claim 1, wherein the junction is not rectilinear and has a local curvature, the radius of which is more than at least five times the external radius of the hem.

7. The manufacturing method according to claim 1, wherein, blocking of said hem is reinforced by locally crushing the hem with a press tool.

8. The manufacturing method according to claim 1, wherein said cut-outs comprise a plurality of teeth separated by a plurality of gaps.

9. The manufacturing method according to claim 8, wherein said teeth present a height less than a circumference of the hem as formed, preferably one third of said circumference, and a width slightly less than the width of said gaps between the teeth.

10. The manufacturing method according to claim 8, wherein, during the assembling of said sheet metal part, the teeth of an innermost part relative to an axis of the hem are imbricated in the gaps of an outermost part relative to said axis.

11. Product obtained by the manufacturing method described in claim 1, having at least two simple sheet metal parts in order to create a structural component, at least one said metal part having a very high elastic limit, wherein the metal parts have been formed by at least a bending process and are arranged with respect to each other along a junction section and are assembled with a curved hem along said junction section, said hem mechanically reinforcing the structure.

12. The product according to claim 11, wherein a ratio of a radius of the hem to a sum of thicknesses of the various parts that are assembled along the junction section is between 2 and 10.

13. The product according to claim 11, wherein a ratio of difference between a hem radius and a thickness of an outermost sheet metal part with a thickness of an innermost sheet metal part is more than 2.

14. The product according to claim 11, wherein the product is in the form of a two-web I-shaped girder obtained by assembling four constituent parts connected by four hems along the junction section of the four parts taken in pairs.

15. The product according to claim 4, wherein the products results from assembling two parts by means of two hems so as to form a closed cross section, at least one of the two parts having a U-shaped cross section.

* * * * *